United States Patent [19]

Murasawa et al.

[11] Patent Number: 4,579,082

[45] Date of Patent: Apr. 1, 1986

[54] DEVELOPING APPARATUS

[75] Inventors: Yoshihiro Murasawa; Kimio Nakahata, both of Kawasaki, Japan

[73] Assignee: Canon Kabushiki Kaisha, Tokyo, Japan

[21] Appl. No.: 527,397

[22] Filed: Aug. 29, 1983

[30] Foreign Application Priority Data

Sep. 2, 1982 [JP] Japan ..... 57-153022
Apr. 26, 1983 [JP] Japan ..... 58-73238
Apr. 26, 1983 [JP] Japan ..... 58-73239

[51] Int. Cl.[4] ..... G03G 15/09
[52] U.S. Cl. ..... 118/658
[58] Field of Search ..... 118/658

[56] References Cited

U.S. PATENT DOCUMENTS 4,292,387 9/1981 Kanbe et al. ..... 430/102
4,350,440 9/1982 Watanabe ..... 118/658 X
4,368,971 1/1983 Watanabe et al. ..... 118/658 X
4,386,577 6/1983 Hosono et al. ..... 118/657
4,387,664 6/1983 Hosono et al. ..... 118/658
4,391,512 7/1983 Nakamura et al. ..... 118/658 X

*Primary Examiner*—Bernard D. Pianalto
*Attorney, Agent, or Firm*—Fitzpatrick, Cella, Harper & Scinto

[57] ABSTRACT

A developing apparatus wherein a thin layer of a non-magnetic developer is formed on a developer carrying member includes a developer container for containing a mixture of non-magnetic developer and magnetic particles; a device disposed adjacent to a non-magnetic developer outlet of developer container with a clearance with respect to a surface of developer carrying member, for regulating supply of the non-magnetic developer to developer carrying member surface; magnetic field generating device, disposed across developer carrying member with respect to regulating device, for forming a magnetic brush of the magnetic particles at the upstream side of regulating device with respect to movement of developer carrying member to confine the magnetic particles within developer container.

9 Claims, 7 Drawing Figures

DEVELOPING APPARATUS

BACKGROUND OF THE INVENTION

1. Field of the Invention

The present invention relates to a developing apparatus for developing a latent image with a non-magnetic developer, more particularly to an apparatus of the type wherein a thin layer of a non-magnetic developer is formed on a developer carrier or a sleeve.

2. Description of the Prior Art

Conventionally, various types of apparatus have been proposed and put into practice as to a dry type one-component developer apparatus. However, in any of those types, it has been very difficult to form a thin layer of one-component dry developer, so that a relatively thick layer of the developer is used. On the other hand, the recent device for the improved sharpness, resolution or the other qualities has necessitated the achievement of the system for forming a thin layer of one-component dry developer.

A method of forming a thin layer of one-component dry developer has been proposed in U.S. Pat. Nos. 4,386,577 and 4,387,664, and this has been put into practice. However, this is the formation of a thin layer of a magnetic developer, not of a non-magnetic developer. The particles of a magnetic developer must each contain a magnetic material to gain a magnetic nature. This is disadvantageous since it results in poor image fixing when the developed image is fixed on a transfer material, also in poor reproducibility of color (because of the magnetic material contained in the developer particle).

Therefore, there has been proposed a method wherein the developer is applied by cylindrical soft brush made of, for example, beaver fur, or a method wherein the developer is applied by a doctor blade to a developer roller having a textile surface, such as a velvet, as to a formation of non-magnetic developer thin layer. In case where the textile brush is used with a resilient material blade, it would be possible to regulate the amount of the developer applied, but the applied toner layer is not uniform in thickness. Moreover, the blade only rubs the brush so that the developer particles are not charged, resulting in foggy images. It should be noted that the non-magnetic developer particles cannot be conveyed by magnetic force since they are not influenced by magnetic field.

SUMMARY OF THE INVENTION

It is, therefore, a principal object of the present invention to provide a developing apparatus wherein a thin layer of non-magnetic developer is formed on the developer carrier surface.

Another object of the present invention is to provide a developing apparatus which is applicable to a multicolor development with faithful color reproducibility.

A further object of the present invention is to provide a developing apparatus wherein the non-magnetic developer particles are triboelectrically charged to a sufficient extent and coated on the developer carrier surface.

These and other objects, features and advantages of the present invention will become more apparent upon a consideration of the following description of the preferred embodiment of the present invention taken in conjunction with the accompanying drawings.

DESCRIPTION OF THE PREFERRED EMBODIMENTS

Figure 1:
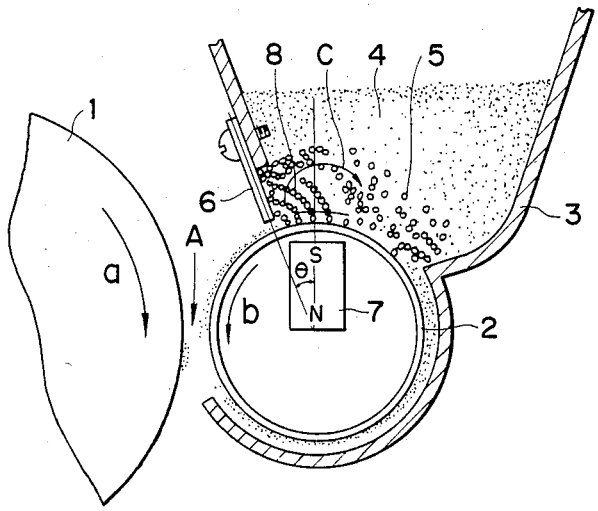
FIG. 1 shows a fundamental mechanism of development.

FIG. 1 shows the cross-section of the developing apparatus to illustrate the principle of the development operation. The apparatus comprises an electrophotographic photosensitive drum 1 as a latent image bearing member which bears a latent image formed by an unshown latent image forming means. It is rotatable in the direction shown by arrow a passing through the developing station A, where a non-magnetic sleeve 2, as a developer carrier for carrying a developer, is faced thereto with a predetermined gap or clearance. The sleeve 2 rotates in the direction shown by arrow b. Above the sleeve 2 is a developer container, made of non-magnetic material such as resin or aluminium, for containing a mixture of non-magnetic developer particles 4 and magnetic particles 5. The developer container 3 has, at its downstream side with respect to movement of the sleeve 2, a magnetic blade 6 screwed to the container 3 as a means for regulating the supply of the non-magnetic developer to the developing station.

Across the sleeve 2, a magnet 7 is provided as a magnetic field generating means. The position of the magnet 7 is determined in connection with the position of a magnetic pole S and the position of the magnetic blade 6, and practically, the pole S is positioned slightly upstream of the magnetic blade 6 position. This arrangement provides better prevention of magnetic particle leakage through the clearance between the magnetic blade 6 and the sleeve 2 surface and better application of the non-magnetic developer onto the sleeve 2 surface.

In the above arrangement, the magnetic particles within the container 3 form a magnetic brush by the magnetic field formed between the magnetic pole S of the magnet 7 and the magnetic blade 6. Upon rotation of the sleeve 2, magnetic particles and non-magnetic developer are mixed and stirred, while the magnetic brush 8 is kept formed. In the neighborhood of the magnetic blade 6, the mixture of non-magnetic developer and magnetic particles are stopped by the magnetic blade 6 so that the mixture moves upwardly and circulates as shown by arrow c.

The non-magnetic developer is charged triboelectrically by the friction with the magnetic particles. The charged developer is uniformly coated on the sleeve 2 by the image force as a thin layer of non-magnetic developer and conveyed to a developing station A where it is faced to the photosensitive drum 1.

The magnetic particles constituting the magnetic brush 8 are prevented from going out through the clearance between the magnetic blade and the sleeve 2, by setting the confining force of the magnetic field by the magnet 7 to be larger than the conveying force caused by the electrostatic attraction force or friction between the sleeve 2 and the magnetic particles. And, when the magnetic brush contains non-magnetic developer, the content of the developer in this brush is maintained constant by the rotation of the sleeve 2, so that the consumption of the developer is automatically compensated by the non-magnetic developer supplied to the magnetic brush 8. Thus, a constant amount of the non-magnetic developer is coated on the sleeve 2.

In the foregoing explanation of the principal mechanism, the regulating member is a magnetic blade. However, non-magnetic blade or a non-magnetic wall of the container 3 made of a resin or aluminium can be used as the regulating member. In those cases, the clearance between the blade 6 and the sleeve is required to be smaller than when the magnetic blade is used. The use of the magnetic blade is preferable in that the magnetic field formed between the blade and the magnetic pole is effective to form a stable magnetic brush at the outlet of the developer and to confine and circulate the magnetic particles.

Figure 2:
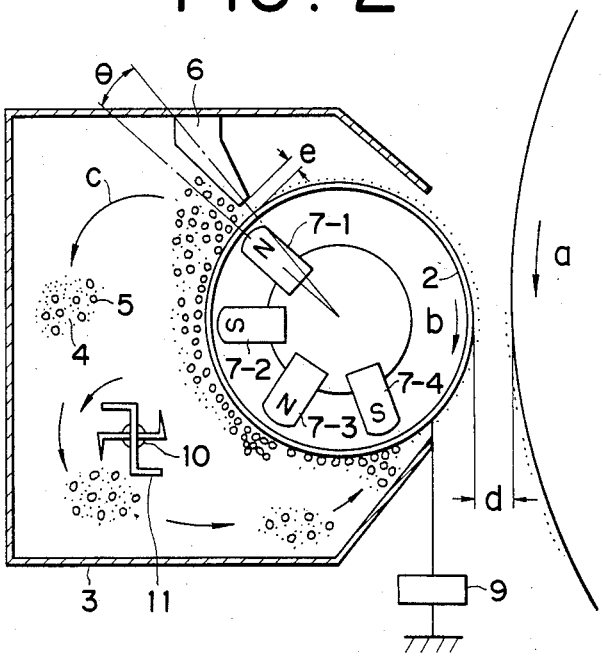
FIG. 2 is a cross-section of an apparatus according to an embodiment of the present invention.

FIG. 2 shows an embodiment of the present invention, wherein the same reference numerals are added for the means or elements which have the similar functions as with FIG. 1 apparatus. The apparatus of FIG. 2 comprises a photosensitive drum 1, a developing sleeve 2 for carrying the developer, a magnetic blade 6, and a developer container 3 wherein a mixture of the non-magnetic developer particles 4 and the magnetic particles 5 is contained. The magnetic particles and the non-magnetic developer particles (toner) constitute a developer mixture. Within the sleeve 2, there are provided magnets 7-1, 7-2, 7-3 and 7-4. The sleeve 2 is supplied with a bias voltage by a bias source 9. The container 3 is provided with stirring blades 11 rotatable about a shaft 10. Within the container, the developer particles and the magnetic particles are weakly attracted together by an electrostatic force, and they are attracted toward the conveying magnets 7-2, 7-3 and 7-4, so that they are attached to the surface of the sleeve 2.

Here, the function of the magnetic particles is to disperse therein the non-magnetic toner particles and convey with themselves the non-magnetic toner particles with the sleeve 2 rotation. Therefore, looking at the particles limitedly within the container 3, the magnetic particles and the non-magnetic toner constitute together a two component developer. However, the toner content (25–70 wt. %) is several times that of the two component developer (e.g. 2–12 wt. %) used with usual magnet brush development.

The mixture on the sleeve 2 is conveyed to the magnetic blade 6 with the rotation of the sleeve 2. During this conveyance, the mixture of the non-magnetic toner particles and the magnetic particles is attracted to and rubbed with the sleeve 2 by the magnetic force, so that the non-magnetic toner particles are electrostatically attracted to the surface of the sleeve 2. In the neighborhood of the magnetic blade 6, the magnetic particles stagnate under the influence of the magnetic field formed between the magnet 7-1 and the magnetic blade 6 to form a brush, and the magnetic particles are scraped off the sleeve 2 surface by the magnetic blade 6.

On the other hand, the non-magnetic toner 4 deposited on the sleeve 2 surface is not influenced by the magnetic field and passes under the magnetic blade 6, so that a thin layer of the non-magnetic toner 4 is formed on the sleeve 2. The thin layer is brought to the developing position or zone A where the photosensitive drum 1 and the sleeve 2 are close to each other. In order to prevent the magnetic particles from leaking under the magnetic blade 6, the cutting magnetic pole 7-1 is deviated toward the inside of the container 3 by 5°–15° (angle $\theta$ in FIG. 2), i.e., toward the upstream side with respect to the movement of the sleeve 2. Thus, by placing all of the magnetic poles 7-1, 7-2, 7-3 and 7-4 inside the container 3, the magnetic flux does not leak toward the developing position A from the magnetic blade 6, that is, the magnetic flux is limited within the container 3. It follows that the magnetic particles are hardly conveyed out of the container 3.

Figure 3:
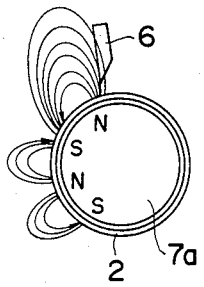
FIG. 3 illustrates the magnetic flux around the developer carrier surface.

More particularly, the developer mixture containing the non-magnetic toner are held on the sleeve 2 and conveyed toward the magnetic blade 6. The magnetic pole 7-1 within the sleeve 2 is deviated slightly with respect to the magnetic blade 6, so that the magnetic flux there is weak. Therefore the force confining the developer mixture on the sleeve 2 is also weak, the developer mixture is pushed by the developer mixture upstream thereof to move away from the sleeve 2 along the magnetic blade 6. The developer moves as shown by arrow c within the sleeve 3 to form a large circulation and is stirred. In the neighborhood of the blade 6 tip, it is believed that there is small circulation and vibration caused by the sleeve 2 rotation to increase the opportunity of the contact between the non-magnetic toner and the sleeve 2, thus giving a sufficient triboelectric charge to the non-magnetic toner. Simultaneously, the small circulation and vibration make the toner contained in the mixture at a larger content separate therefrom and attach to the sleeve 2 surface, thereby providing a uniform toner coating thereon. At this time, the magnetic particles each function as small induced magnets to exhibit the binding forces with each other and are confined within the container 3. The magnetic field in this state is as shown in FIG. 3, that is, there is hardly any magnetic flux downstream of the magnetic blade 6. Therefore, the magnetic particles 5 are hardly drawn out of the container 3 through the clearance between the blade 6 and the sleeve 2. In FIG. 3, the magnet is shown as a magnet roller *7a*.

At the developing station A, the clearance d between the photosensitive drum 1 and the developing sleeve 2 is such that the thin layer of the toner on the sleeve 2 does not contact the drum 1 surface without the external electric field. Thus, there is a gap between the toner layer and the drum 1 surface. Upon the development operation, the sleeve 2 is supplied with DC, AC or AC superposed with AC power by the bias power source 9 to render the potential to be predetermined, so that a desired image can be provided. Especially, the alternating voltage disclosed in U.S. Pat. Nos. 4,292,387 and 4,395,476 may be applied as the bias so as to perform the so-called jumping development.

In this embodiment, the non-magnetic toner is charged by friction with the magnetic particles and the sleeve 2 surface. Preferably, the magnetic particles are treated to be insulative by an oxidation coating or by a resin which has the same or similar electrostatic level as with the toner particles, so that the triboelectric charge to the toner from the magnetic particles is reduced and that the charge necessary for the development is given only from the sleeve 2 surface. Then, the deterioration of the magnetic particles are minimized, and the application of the toner onto the sleeve surface becomes easier. The magnetic particles are not directly involved in the developing operation, but function to convey and stir the non-magnetic toner. Therefore, only the non-magnetic toner may well be supplied. In this sense, the magnetic particles of the developer mixture are a part of the developing apparatus rather than a part of the developer agent. The fixed magnet within the sleeve 2 is such as to make the magnetic field exist limitedly within the container 3. The magnetic flux at the surface of the sleeve 2 needs to be 400–600 G.

As for the image bearing member 1 may be drum or web which may comprise a photosensitive member or an insulating member. As for the toner carrier, a sleeve of aluminium, Cu, stainless steel, brass or other non-magnetic metal or of a synthetic resin, or it may be an endless web of a resin or metal.

In this specification, the properties of the developer used with this type of development system are clarified. The non-magnetic toner, in this type of development, is required to be dispersed in the magnetic particles and to be deposited together on the sleeve 2 surface, so that they are conveyed near the blade 6. The content of the toner particles is needed to be such that the toner separates when they make various motions under the influence of the blade 6. Also, it is necessary for the magnetic particles to bind each other so as to prevent them from leaking out under the blade 6 tip.

To meet this, the present invention preferably uses the magnetic particles having diameter of 30–100μ and toner content of 25–70 wt. %. The magnetic particle having diameter less than 30μ has less magnet nature as a particle of power, and as a result the binding force among them are so weak that a part of the magnetic particles passes by the blade 6 with the rotation of the sleeve 2. They will reach the developing zone to cause a short circuit between the sleeve 2 and the photosensitive member 1. The magnetic particle larger in diameter than 100μ has such a strong magnet nature that they are strongly bound together, resulting in insufficient circulation and vibration in the neighborhood of the blade 6. Therefore, it is not easy for the toner to separate there. This leads to a so-called vacant lines in the toner layer, where there is no toner in the circumferential direction of the sleeve 2.

Since the toner triboelectrically charged by the magnetic particles and the sleeve 2 has to be released from the magnetic particles and attach to the sleeve 2 surface, the toner content is several times that of usual two component developer (2–12 wt. %).

Figure 4:
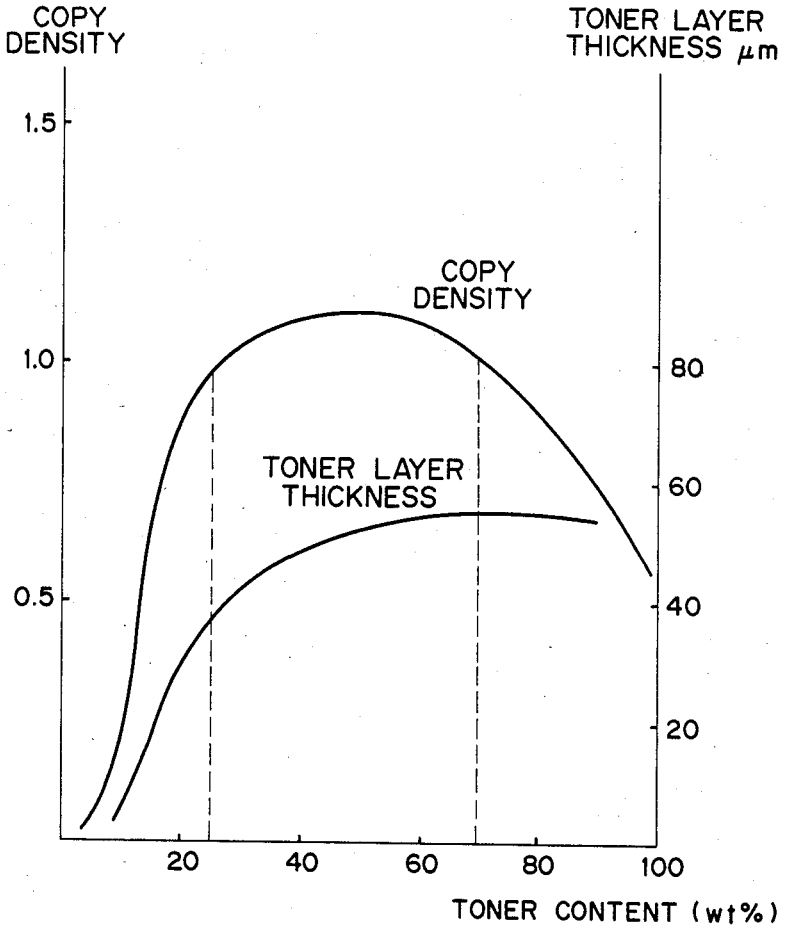
FIG. 4 is a graph showing a relation between the copy density and the thickness of the toner layer when the amount of the toner is changed.

FIG. 4 is a graph showing the change of the copy density and the thickness of the toner layer formed on the sleeve 2, when the toner content changes (wt. %). As will be apparent from this graph, with the increase of the toner content, the thickness of the toner layer increases gradually. On the other hand, the copy density one steeply increases, but thereafter, it does not increase much with the increase of the toner content. When the toner content is too high, the copy density decreases. This is thought to be because the increase of the toner content results in the decrease of the opportunity of the contact between the toner particles and magnetic particles, so that the toner is not charged enough to develop the latent image.

It is, therefore, preferable that the toner content is such as to provide a copy density not less than 1.0, i.e., the toner content of 25–70 wt. %. It has been found that with the toner content of less than 25 wt. %, the amount of toner separating from the mixture is small so that the coating of the toner on the sleeve 2 is too thin to provide a satisfactory image. On the contrary, with the toner content over 70 wt. %, the force for attaching the toner on the sleeve 2 surface was so small that the coating was not uniform. Additionally, the toner was deposited on the non-image area, i.e., the foggy image is resulted.

Experiments was conducted with the apparatus shown in FIG. 2 having the following dimensions and parameters and using the following developer mixtures:

1. Sleeve 2: 32 mm (outerdiameter).
2. Rotation of Sleeve 2: Same as Drum 1 (300 mm/s).
3. Magnetic Poles 7-1, 7-2, 7-3 and 7-4: 400 Gauss at the sleeve 2 surface.
4. Clearance e between the sleeve 2 and the magnetic blade: e=0.5 mm.
5. Angle $\theta$ between the magnetic pole 7-1 and the magnetic blade 6: $\theta=10°$.
6. Clearance d between the sleeve 2 and the drum 1: d=0.3 mm.
7. Electric bias by the bias source 9: AC, Frequency=600 Hz, Peak-to-Peak voltage=1.5 KV, Central voltage=150 V (same polarity as with the latent image).

In all cases, satisfactory image density was provided.

EXAMPLE 1

Magnetic Particles: Iron particles treated by surface oxidation (used in ordinary electrophotographic process and having blue color surface); 200–300 mesh (particle size 50–100μ).

Toner Particle Size: Ave. 10μ

Toner Content: 40 wt. %

EXAMPLE 2

Magnetic Particles: Iron particles treated by surface oxidation; 400–500 mesh (particle size 30–40μ).

Toner Particle Size: Ave. 10μ

Toner Content: 60 wt. %

As a comparison, the data of two component developer used with ordinary magnet brush developing device are as follows:

COMPARISON EXAMPLE 1

Two component developer by company A:
Average Particle size of carrier: 100μ
Average Particle size of toner: 8μ
Toner content: 2 wt. %
Photosensitive member to be developed: Se

COMPARISON EXAMPLE 2

Two component developer by company B:
Average particle size of carrier: 30μ
Average particle size of toner: 8μ
Toner content 8 wt. %
Photosensitive member to be developed: CdS

COMPARISON EXAMPLE 3

Two component developer for NP5000 copying machine by CANON:
Average particle size of carrier: 60μ
Average particle size of toner: 7μ
Toner content: 12 wt. %

Photosensitive member to be developed: Surface insulative layer type.

As will be understood from the above, relatively lower toner content (2–12 wt. %) is used in conventional magnet brush development using two component developer. This is because, in such development systems, the toner is deposited to the image area sufficiently, but it is necessary to remove the once deposited toner from the background, i.e., non-image area. That is, the background fog must be avoided. Therefore, the toner content must be kept suitably low depending on the particle size of the carrier or on the nature of the photosensitive member.

In the development system according to the present invention, however, only non-magnetic toner is coated on the non-magnetic sleeve 2, and the sleeve 2 is spaced apart from the photosensitive member by the distance larger than the thickness of the coated layer, so that the high toner content developer can be used. And, the stable image density can be maintained for a large number of copy operations.

The non-magnetic developer usable with the invention is the developer used with conventional electrophotographic machines, that is, the one made by mixing a dye or pigment in a resin and particulating it or encapsulating it. As for the magnetic particles, iron particle, ferrite or those bound by a resin are usable.

As described in the foregoing, the non-magnetic developer and the magnetic particles are stirred and circulated, and only the non-magnetic developer is coated on the developer carrier 2 as a thin layer, which is used to develop the latent image, and wherein the particle size of the magnetic particles and the content of the non-magnetic developer are determined to provide a stable image forming operation. Also, since the developer used in the developing action contains the non-magnetic developer only, it can be used for multicolor development.

In the apparatus shown in FIG. 1 or FIG. 2, it is necessary for the non-magnetic toner to be deposited on the sleeve 2 surface and to be regulated in its thickness by the magnetic blade and to be coated as a predetermined thickness layer. It is, on the other hand, necessary for the sleeve 2 surface to convey the developer mixture to the magnetic blade 6 and to circulate it and vibrate it up and down in the neighborhood of the blade 5, thus separating the toner out of the mixture. Also, the sleeve 2 surface is to be such that it does not pull the magnetic particles out of the container 3 through the clearance under the blade 6.

According to an aspect of the present invention, the sleeve 2 surface is treated by sandblasting to have a rough surface.

With no roughening or with very small roughness, a desired thickness of the toner layer is not obtained on the sleeve 2 under the usual conditions, resulting in low density image. Under the low humidity condition, the toner layer on the sleeve can have a local spot where the toner is highly charged triboelectrically resulting in a locally thick portion. This causes non-uniform toner layer, so that the background of the copy can have a toner.

On the contrary, if the roughness is too large, the electric field at the developing position concentrates on the peaks of the roughness, which results in non-uniform solid black image in the resultant copy. In addition, the thickness of the toner layer becomes so large that the toner tends to scatter and to cause a foggy image. Also, with the long term use, the toner can be fused and attached to the valleys of roughness.

Figure 5:
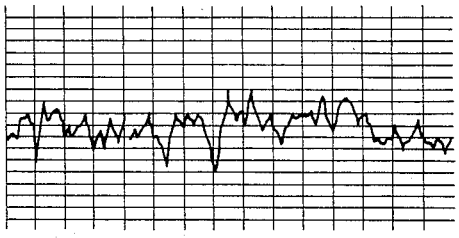
FIG. 5 shows a roughness of the developer carrier surface.
Figure 6:
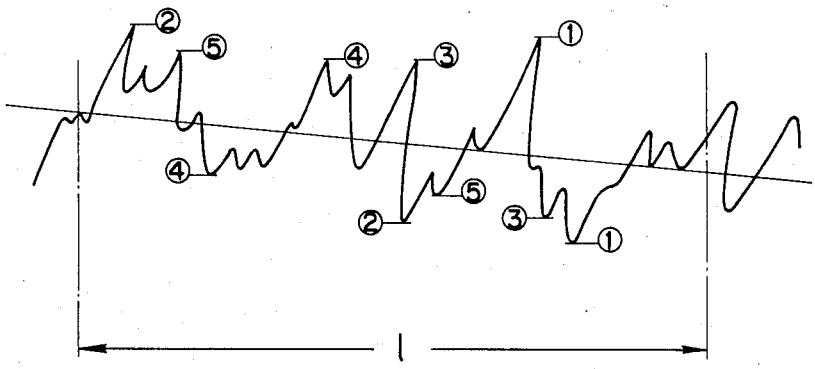
FIG. 6 shows a measurement of the developer carrier surface roughness measured by a surface roughness measuring device.

It follows that the roughness is preferably within a certain range. Practically, however, it is not possible to definitely define the surface roughness. As an example, when the roughened surface of FIG. 5 is measured by a fine roughness meter (sold by Tailor Bobson Company, Kosaka Kenkyujo), the waveform as shown in FIG. 6 is obtained. This will be used for controlling the surface conditions.

The surface roughness is measured in accordance with JIS 10-point average roughness (RZ) "JIS B 0601". As shown in FIG. 6, a reference length l is taken out of the waveform of the cross-section; and average line for this range is drawn. Then, a line parallel to the average line and passing through the peak of the third highest peak is drawn, and a line also parallel to the average line and passing through the valley of the third lowest valley is drawn. And, the distance between those two lines is expressed in micrometer ($\mu$m). The reference length is selected to be 0.25 mm. The pitch of the roughness is determined in the following manner. The peaks are defined as being not less than 0.1$\mu$ higher than the adjacent two valleys, and the number of peaks in the reference length is counted. Then the pitch P is defined as 250$\mu$/Number of Peaks contained in the Reference length.

In accordance with the above definition, an embodiment of the present invention has shown that the sandblasting treatment by irregular particles, providing the surface conditions where there are random roughnesses of the pitch P (FIG. 6 distance between high peak and low valley, or the average distance between the average peak and average valley) ranging between 5–50 $\mu$m and of the above defined roughness Rz ranging from 1–5$\mu$, is preferable.

The irregular particles here is the abrasive particles of a predetermined range of sizes, for example, 20–70$\mu$, which have been taken out of the particulate hard materials, such as carbon, silicon carbide, alumina and the like. As for the shape, the particle has sharp edges which provide on the sleeve 2 surface with peaks and valleys having sharp edges. The surface roughened by irregular particles has a very high friction resistance to promote the toner conveyance and magnetic particle movement.

It has been found that the toner conveyance is improved if the surface roughness is not less than 0.1$\mu$, when the sleeve surface is roughened by irregular abrasive particles. However, the effect of promoting the magnetic particle movement was still small, and the toner separated out was not enough, so that only a very thin layer was provided. So, the surface roughness was increased to 1$\mu$ or more, and it was found that sufficient toner coating was obtained. It has also been found that with the surface roughness of 5$\mu$ or more, the magnetic particle conveying ability is so strong that the magnetic particles are pulled out under the magnetic blade 6, particularly the smaller particles.

When the pitch is not more than 5$\mu$, the effect of the roughening has not been provided. The conveyance of the magnetic particles was not good, resulting in non-uniform triboelectric charge to the toner, and therefore, non-uniform toner coating. Over 50$\mu$ of the pitch, the rate of the change of peaks and valleys (=surface roughness Rz/pitch P) became small, so that the effect of movement promotion was small. Therefore, the sandblasting by irregular particles providing the roughness Rz=1–5μ, pitch P=5–50μ was used in the present invention.

The apparatus of FIG. 2 was operated under the following conditions:

1. Sleeve 2: 32 mm (outerdiameter).
2. Rotation of Sleeve 2: Same as Drum 1 (300 mm/s).
3. Magnetic Poles 7-1, 7-2, 7-3 and 7-4: 400 Gauss at the sleeve 2 surface.
4. Clearance e between the sleeve 2 and the magnetic blade 6: e=0.5 mm.
5. Angle θ between the magnetic pole 7-1 and the magnetic blade 6: θ=10°.
6. Clearance d between the sleeve 2 and the drum 1: d=0.3 mm.
7. Electric bias by the bias source 9: AC, Frequency=600 Hz, Peak-to-Peak voltage=1.5 KV, Central voltage=150 V (same polarity as with the latent image).
8. Developer mixture: Black toner (Well-known non-magnetic resin toner) and magnetic particles.

EXAMPLE 1

The sandblasting particles for the sleeve 2 (stainless steel SUS 304) was MORANDAM No. 600 (SHOWA DENKO K.K.) which were alumina abrasive particles having particle size of 25μ. The blasting nozzle having 7 mm diameter was spaced from the surface by 150 mm. The blasting continued for 2 minutes under the air pressure of 4 Kg/cm$^2$. The resultant roughness was Rz=1μ and P=5–20μ.

When the development operation was actually carried out under the above conditions, the toner coating on the sleeve 2 surface was very good without non-uniformity. The continuous developing operations were performed, and it was corfirmed that good images can be maintained without non-uniform development.

EXAMPLE 2

The sandblasting particles for the sleeve 2 (aluminium) was GREENDENSHICK No. 400 (SHOWA DENKO K.K.) which were silicon carbide abrasive particles having particle size of 35μ. The blasting nozzle having 7 mm diameter was spaced from the surface by 250 mm. The blasting continued for 2 minutes under the air pressure of 4 Kg/cm$^2$. The resultant roughness was Rz=2μ and P=15–30μ.

When the development operation was actually carried out under the above conditions, the toner coating on the sleeve 2 surface was very good without non-uniformity. The continuous developinq operations were performed, and it was confined that good images can be maintained without non-uniform development.

EXAMPLE 3

The sandblasting particles for the sleeve 2 (stainless steel SUS 304) was MORANDAM No. 200 (SHOWA DENKO K.K.) which were alumina abrasive particles having particle size of 50μ. The blasting nozzle having 7 mm diameter was spaced from the surface by 150 mm. The blasting continued for 2 minutes under the air pressure of 4 Kg/cm$^2$. The resultant roughness was Rz=5μ and P=20–50μ.

When the development operation was actually carried out under the above conditions, the toner coating on the sleeve 2 surface was very good without non-uniformity. The continuous developing operations were performed, and it was confined that good images can be maintained without non-uniform development.

In addition to the Examples stated above, other sizes and kinds of particles may be used, depending on the material of the sleeve surface, if the blasting nozzle diameter, the distance between the nozzle and the surface and the blasting pressure are suitably selected. With the apparatus tested, the irregular abrasive particles of No. 200–No. 600 were found to be satisfactory.

Generally, the abrasive particles are categorized into two groups, one is the irregular and the other, regular. The irregular one is called grinding material and has sharp edges. The regular one has generally spherical shape. When the irregular particles are used, the roughened surface can have fine edges. The sleeve surface roughened to Rz=1–5μ shows stable toner coating and good initial operation, when used with the above described developing apparatus.

However, it has been found that, with the use, the sharp peaks of the roughened surface are worn by the mixture developer containing the magnetic particles, thus decreasing the toner conveyance ability. When an aluminium sleeve is used, the image density decreases after 3,000 copies taken. When using stainless steel (SUS 304) sleeve, it decreases after 30,000 copies.

On the other hand, when the regular abrasive particles were used, the peaks and valleys were round, and the service life of the sleeve was elongated.

So, with the following examples, the sleeve 2 roughened by regular particles will be discussed. The regular particles here are the particles of, e.g., glass and iron, having 50–70μ particle size, for example. As for the shape, it is generally spherical sharp without edges, which provide a sleeve surface like an aventurine surface.

With the sleeve roughened by the regular particles, the toner conveyance ability was improved when the surface roughness is not less than 1μ. However, the effect of magnetic particle movement promotion was not good, and the separated toner was not enough so that only a thin layer was obtained. Over 2μ of the roughness, sufficient toner coating was provided. Over 10μ of the roughness, however, the magnetic particle conveyance ability was so strong that the magnetic particles were drawn out of the container 3 under the magnetic blade, particularly the small size particles.

As for the pitch of roughness, the effect of roughening was not recognized under 10μ. So, the magnetic particles were not moved sufficiently, and the triboelectric charge to the toner was not uniform, with the result that the toner coating was not uniform. Over 70μ of the pitch, on the contrary, the change rate of the peaks and valleys (=surface roughness Rz/pitch P) became low so that the effect of promotion of the developer mixture movement was low. Therefore, according to the present invention, when the regular abrasive particles are used, Rz=2–10μ, Pitch P=10–70μ of the sleeve surface roughness is preferable.

The experiments have been carried out with the apparatus shown in FIG. 2 under the following conditions:

1. Sleeve 2: 32 mm (outerdiameter).
2. Rotation of Sleeve 2: Same as Drum 1 (300 mm/s).
3. Magnetic Poles 7-1, 7-2, 7-3 and 7-4: 400 Gauss at the sleeve 2 surface.
4. Clearance e between the sleeve 2 and the magnetic blade 6: e=0.5 mm.
5. Angle θ between the magnetic pole 7-1 and the magnetic blade 6: θ=10°.
6. Clearance d between the sleeve 2 and the drum 1: d=0.3 mm.

7. Electric bias by the bias source 9: AC, Frequency=600 Hz, Peak-to-Peak voltage=1.5 KV, Central voltage=150 V (same polarity as with the latent image).

8. Developer mixture: Black toner (Well-known non-magnetic resin toner) and magnetic particles.

EXAMPLE 4

The sandblasting particles for the sleeve 2 (stainless steel SUS 304) was FGB No. 300 (FUJI SEISAKUSHO) which were generally spherical glass beads having particle size of 50μ. The blasting nozzle having 7 mm diameter was spaced from the surface by 150 mm. The blasting continued for 2 minutes under the air pressure of 3 $Kg/cm^2$. The resultant roughness was Rz=2μ and P=10–30μ.

When the development operation was actually carried out under the above conditions, the toner coating on the sleeve 2 surface was very good without non-uniformity. The continuous developing operations were performed, and it was confirmed that good images can be maintained without non-uniform development.

EXAMPLE 5

The sandblasting particles for the sleeve 2 (aluminium) was FGB No. 300 (FUKI SEISAKUSHO) which were generally spherical glass beads having particle size of 50μ. The blasting nozzle having 7 mm diameter was spaced from the surface by 250 mm. The blasting continued for 2 minutes under the air pressure of 3 $Kg/cm^2$. The resultant roughness was Rz=4μ and P=20–40μ.

When the development operation was actually carried out under the above conditions, the toner coating on the sleeve 2 surface was very good without non-uniformity. The continuous developing operations were performed, and it was confirmed that good images can be maintained without non-uniform development.

EXAMPLE 6

The sandblasting particles for the sleeve 2 (stainless steel SUS 304) was FGB No. 200 (FUJI SEISAKUSHO) which were generally spherical glass beads having particle size of 50μ. The blasting nozzle having 7 mm diameter was spaced from the surface by 150 mm. The blasting continued for 2 minutes under the air pressure of 4 $Kg/cm^2$. The resultant roughness was Rz=10μ and P=30–70μ.

When the development operation was actually carried out under the above conditions, the toner coating on the sleeve 2 surface was very good without non-uniformity. The continuous developing operations were performed, and it was confirmed that good images can be maintained without non-uniform development.

With the use of the sleeves 2 of the Examples 4–6, the continuous operations were carried out, and it was found that the image quality was maintained until 20,000 copies were taken in the case of aluminium sleeve, and until 150,000 copies were taken in the case of stainless steel sleeve (SUS 304).

In addition to the Examples stated above, other sizes and kinds of particles may be used, depending on the material of the sleeve surface, if the blasting nozzle diameter, the distance between the nozzle and the surface and the blasting pressure are suitably selected. With the apparatus tested, the regular abrasive particles of No. 200–No. 300 were found to be preferable.

As described in the foregoing, according to the present invention, in the developing apparatus comprising a container for containing the magnetic particles and non-magnetic toner particles, the magnetic particles being circulated within the container, and only the non-magnetic toner particles being applied on a developer carrier, the surface of the developer carrier is roughened by sandblasting treatment, so that the movement of the non-magnetic developer and the magnetic particles is promoted, and therefore, a uniform and thin layer of the non-magnetic developer can be formed. Additionally, since the developer is non-magnetic, that is, not including magnetic material, color reproduction is possible.

Figure 7:
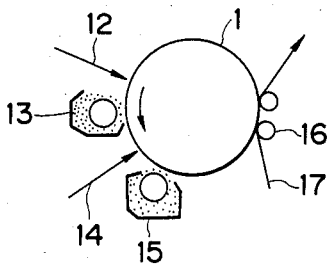
FIG. 7 is a schematic diagram showing two-color development system.

As a simple color image formation system, two-color developing method and apparatus are known. FIG. 7 shows important parts of a two-color device. A first image exposure is effected to image light 12, and the resultant latent image on the photosensitive drum 1 is developed by a first developing device 13. Then, a second image exposure is effected to the image light 14, and the resultant latent image is developed by a second developing device 15. As a result, a visualized image in two colors is formed on the photosensitive drum 1, and then transferred onto a transfer material. In the conventional two-color machine, both of the first and second developing operations are magnet brush development type, so that the visualized image by the first developing device (e.g. black), is disturbed by the magnetic brush of the second developing device (e.g. red), or further developed by the second developing device, resulting in mixture of color.

In place of the magnetic brush development, a jumping development with a one-component developer, as disclosed in U.S. Pat. Nos. 4,292,387 and 4,395,476 has been proposed. According to such a system, the latent image bearing member and the toner layer are spaced, the above described problem of the disturbance to the first image by the second developing device is not involved. That is, the first visualized image is not scraped off by the carriers of second developing device. If the polarity of the first latent image is made opposite to the polarity of the second latent image, and if the polarities of the first developer (e.g. black) and the second developer (e.g. red) are made opposite to each other, so mixture in color results so that ideal two-color development can be provided.

As for the first developing device 13 and the second developing device 15, the apparatus shown in FIG. 2 was used and operated under the following conditions:

1. Sleeve 2: 32 mm (outerdiameter), sandblasted to Rz=3 μm, Stainless Steel.
2. Rotation of Sleeve 2: Same as Drum 1 (300 mm/s).
3. Magnetic Poles 7-1, 7-2, 7-3 and 7-4: 400 Gauss at the sleeve 2 surface.
4. Clearance e between the sleeve 2 and the magnetic blade 6: e=0.5 mm.
5. Angle $\theta$ between the magnetic pole 7-1 and the magnetic blade 6: $\theta=10°$.
6. Clearance d between the sleeve 2 and the drum 1: d=0.3 mm.
7. Electric bias by the bias source 9: AC, Frequency=600 Hz, Peak-to-Peak voltage=1.5 KV, Central voltage=150 V (same polarity as with the latent image).
8. First Developer: Black toner (well-known non-magnetic resin toner) charged to negative.
9. Second Developer: Magenta (ditto) changed to positive.
10. Magnetic Particles: Same kinds for the above two.

The first latent image was positive and the second was negative.

The resultant heat-fixed image on the transfer material was free from the disturbance by the second developing device and the color mixture.

While the invention has been described with reference to the structures disclosed herein, it is not confined to the details set forth and this application is intended to cover such modifications or changes as may come within the purposes of the improvements or the scope of the following claims.

What is claimed is:

1. An apparatus for forming a layer of non-magnetic developer particles on a surface of a developer carrying member comprising:

a developer container for containing magnetic particles and non-magnetic developer particles;

regulating means disposed with a clearance with respect to a surface of the developer carrying member;

first magnetic field generating means stationarily disposed across the developer carrying member from said regulating means to form a magnetic field between said regulating means and first magnetic field generating means to confine the magnetic particles within said developer container;

second magnetic field generating means across the developer carrying member from said regulating means to move a mixture of the magnetic particles and the non-magnetic developer particles; and means for moving the developer carrying member to carry only the non-magnetic developer particles thereon and pass them by a region of the confined magnetic particles, to form a thin layer of the non-magnetic developer particles on the developer carrying member which layer is withdrawn from said container.

2. An apparatus according to claim 1, wherein said first magnetic field generating means includes a magnetic pole for forming a magnetic brush, disposed upstream of said regulating means by at least 5 degree with respect to movement of the developer carrying member.

3. An apparatus according to claim 1 or 2, wherein said regulating means includes a magnetic blade of a magnetic material.

4. An apparatus according to claim 1, wherein the thin layer of the non-magnetic developer is brought on the developer carrying member into facing relation with an image bearing member having an image to be developed, with a clearance between the image bearing member and the thin layer of the non-magnetic developer particles.

5. An apparatus according to claim 4, wherein an alternating bias voltage is applied between the image bearing member and the developer carrying member.

6. An apparatus according to claim 1, wherein the magnetic particle has a diameter of 30–50$\mu$, and the content of the non-magnetic developer particles within the mixture is 25–70 wt. %.

7. An apparatus according to claim 1, wherein the developer carrying member has a rough surface.

8. An apparatus according to claim 7, wherein the developer carrying member has a surface treated by sandblasting with irregular particles, and has the pitch of roughness $P=5-50\mu$ and the roughness $Rz=1-5\mu$.

9. An apparatus according to claim 7, wherein the developer carrying member has a surface treated by sandblasting with regular particles, and has the pitch of roughness $P=10-70\mu$ and the roughness $Rz=2-10\mu$.

* * * * *

UNITED STATES PATENT AND TRADEMARK OFFICE

CERTIFICATE OF CORRECTION

PATENT NO. : 4,579,082

DATED : April 1, 1986

INVENTOR(S) : YOSHIHIRO MURASAWA and KIMIO NAKAHATA

It is certified that error appears in the above-identified patent and that said Letters Patent is hereby corrected as shown below:

Column 4, line 20, change "are" to --is--.

Column 5, line 15, change "1 may" to --1, it may--;
line 61, delete "one".

Column 6, lines 11-12, change "is re-sulted." to --resulted.-- line 13, change "was" to --were--;
line 16, change "(outerdiameter.) to --(outer diameter.)--

Column 8, line 37, change "is" to --are--.

Column 9, line 5, change ("outerdiameter)." to --(outer diameter). -- line 35, change "corfirmed" to --confirmed--;
line 50, change "developinq" to --developing--;
line 51, change "confined" to --confirmed--; and
line 67, change "confined" to --confirmed--.

Column 10, line 26, change "elongated." to --prolonged.--; and
line 59, change "(outerdiameter)." to --(outer diameter).--

UNITED STATES PATENT AND TRADEMARK OFFICE

CERTIFICATE OF CORRECTION

PATENT NO. : 4,579,082

DATED : April 1, 1986

INVENTOR(S) : YOSHIHIRO MURSAWA and KIMIO NAKAHATA

It is certified that error appears in the above-identified patent and that said Letters Patent is hereby corrected as shown below:

Column 12, line 43, delete "so";
line 49, change "(outerdiameter)," to --(outer diameter),--.

Column 14, line 6, change "degree" to --degrees--.

Signed and Sealed this

Third Day of February, 1987

*Attest:*

*Attesting Officer*

DONALD J. QUIGG

*Commissioner of Patents and Trademarks*